US007246763B2

(12) United States Patent
Roberts

(10) Patent No.: US 7,246,763 B2
(45) Date of Patent: Jul. 24, 2007

(54) COMMINUTION APPARATUS

(75) Inventor: James D. Roberts, Albany, OR (US)

(73) Assignee: ATI Properties, Inc., Albany, OR (US)

( * ) Notice: Subject to any disclaimer, the term of this patent is extended or adjusted under 35 U.S.C. 154(b) by 18 days.

(21) Appl. No.: 11/444,679

(22) Filed: Jun. 1, 2006

(65) Prior Publication Data

US 2006/0255198 A1 Nov. 16, 2006

Related U.S. Application Data

(62) Division of application No. 10/614,531, filed on Jul. 7, 2003, now abandoned.

(51) Int. Cl.
*B02C 18/16* (2006.01)

(52) U.S. Cl. ..... 241/243; 241/30; 241/88.4; 241/89.3; 241/167

(58) Field of Classification Search ..... 241/30, 241/31, 57, 67, 167, 190, 242, 243, 86, 88.4, 241/89.3

See application file for complete search history.

(56) References Cited

U.S. PATENT DOCUMENTS 361,000 A * 4/1887 Creager ..... 241/88.4
4,221,341 A * 9/1980 Schymura et al. ..... 241/67
4,641,787 A * 2/1987 Petersen et al. ..... 241/5
4,678,126 A * 7/1987 Prentice et al. ..... 241/34
5,630,554 A * 5/1997 Izumikawa et al. ..... 241/24.13
6,666,395 B2 * 12/2003 Cavalieri ..... 241/85
6,827,304 B2 * 12/2004 Rousseau ..... 241/73
2004/0069879 A1 * 4/2004 Binder et al. ..... 241/30

* cited by examiner

*Primary Examiner*—Derris H. Banks
*Assistant Examiner*—Jason Y. Pahng
(74) *Attorney, Agent, or Firm*—Kirkpatrick & Lockhart Preston Gates Ellis LLP; Patrick J. Viccaro

(57) ABSTRACT

A comminution apparatus for reducing a particle size of a material includes a cutting chamber defining an interior volume, wherein the cutting chamber includes first and second member forming an angle therebetween. Each of the first and second members include a plurality of slots therethrough providing access to the interior volume. The apparatus further includes a rotatable arbor disposed outside the interior volume of the cutting chamber and supporting a plurality of toothed blades thereon. During rotation of the arbor a portion of each of the blades enters an interior volume of the cutting chamber through the slots in the first member and exits the interior volume of the cutting chamber through the slots in the second member. The comminution apparatus may be used to process various feed materials to desired sizes, and is particularly useful for reducing the size of materials otherwise difficult to cut to small size. Such materials include, for example, zirconium, titanium, magnesium, niobium, calcium, copper, potassium, hafnium and aluminum.

13 Claims, 7 Drawing Sheets

COMMINUTION APPARATUS

The present application is a divisional application and claims priority under 35 U.S.C. § 120 from co-pending U.S. patent application Ser. No. 10/614,531, now abandoned, filed on Jul. 7, 2003.

BACKGROUND OF THE INVENTION

Several different types of equipment are used for size reduction or comminution of materials to fine particles or powder. Crushing rolls, rock crushers, hammer mills and ball mills are examples of such equipment, and are generically referred to herein as "comminution apparatus". The decision to select a particular type of comminution apparatus depends, at least in part, on the size distribution desired for the resulting product and on the properties of the feed material. Crushing rolls, for example, may be particularly suitable for coarse size reduction of brittle materials and for materials that fracture under pressure without smearing or flowing.

Certain materials, such as light metals, including zirconium, titanium and niobium, for example, cannot be effectively reduced (i.e., comminuted) to fine powder using crushers because these metals have a tendency to gall, and chips of the metals would stick to the cutting edges. To address this problem, such metals have first been subjected to hydrogen embrittlement and then reduced in, for example, a ball mill. Hydrogen is later removed from the reduced material in a vacuum furnace to produce a suitable metal or metal alloy powder. This process is expensive and may still produce powder containing unacceptably high levels of hydrogen and oxygen.

SUMMARY

One embodiment of the present invention provides a comminution apparatus for reducing a feed material to a desired size. The comminution apparatus includes a cutting chamber defining an interior volume. The cutting chamber includes a first member and a second member forming an angle therebetween. Each of the first member and the second member include a plurality of slots therethrough providing access to the interior volume. The apparatus further includes a rotatable arbor disposed outside the interior volume of the cutting chamber. The arbor supports a plurality of toothed blades thereon. During rotation of the arbor, a portion of each of the blades enters the interior volume of the cutting chamber through the slots in the first member and exits the interior volume of the cutting chamber through the slots in the second member.

The present invention also is directed to a method for reducing a particle size of a feed material. The method includes introducing the feed material into the interior volume of the cutting chamber of a comminution apparatus of the present invention as described immediately above. The arbor is rotated, thereby rotating the plurality of blades and comminuting the feed material within the interior volume of the cutting chamber.

When the foregoing embodiment of the comminution apparatus of the invention and method are used to reduce the size of certain metallic feed materials such as zirconium, titanium and niobium, it has been observed that there is a reduced tendency for the metals to gall relative to results achieved using certain known comminution apparatus. This and other advantages of embodiments of the present invention will be apparent from a consideration of the following detailed description of certain embodiments of the present invention.

BRIEF DESCRIPTION OF THE DRAWINGS

In the accompanying Figures, there are shown certain embodiments of the present invention wherein like reference numerals are employed to designate like parts and wherein.

DESCRIPTION OF EMBODIMENTS OF THE INVENTION

Figure 1:
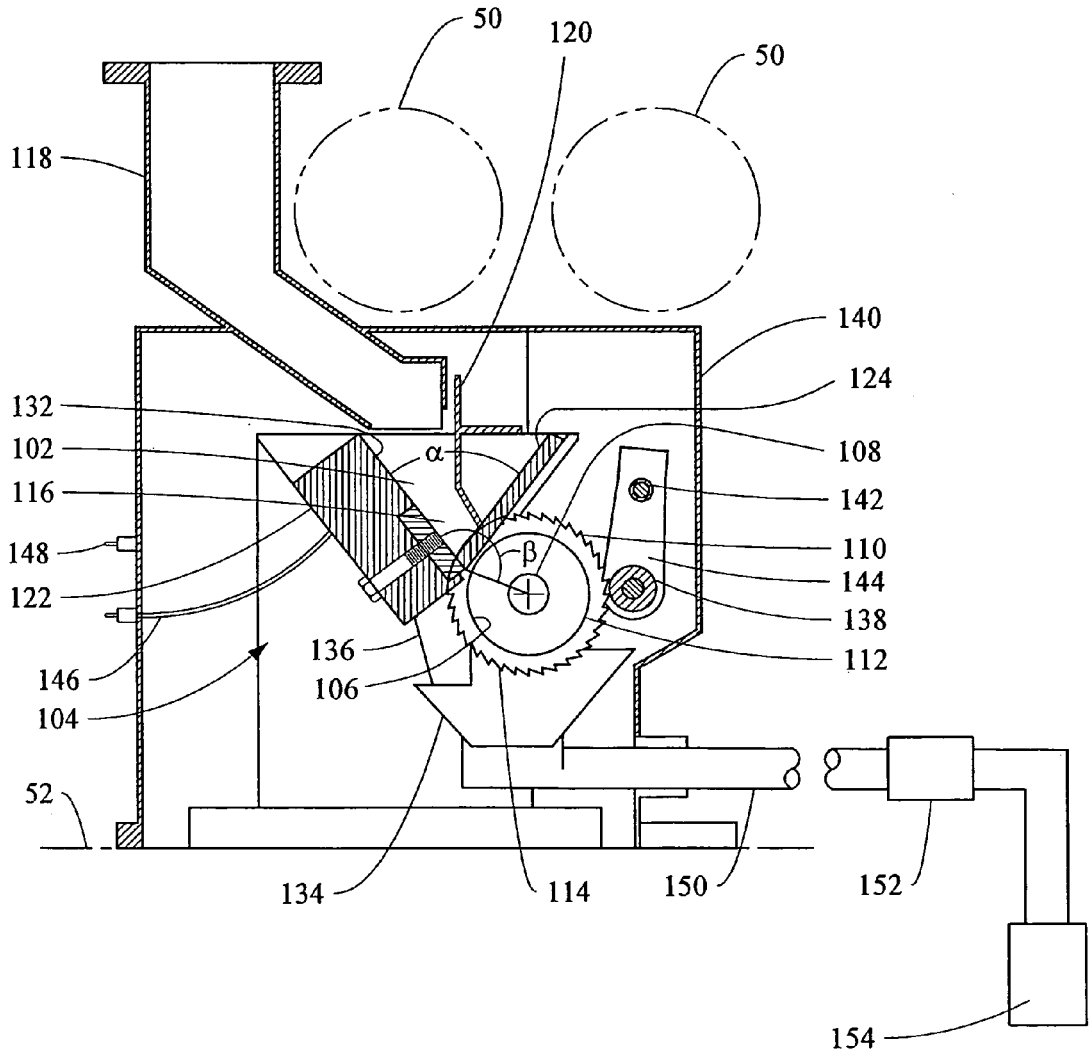
FIG. 1 is a transverse elevational sectional view of an embodiment of the comminution apparatus according to the present invention.

Referring now to the drawings for the purpose of illustrating the present invention and not for the purpose of limiting the same, it is to be understood that certain standard components or features that are within the purview of an artisan of ordinary skill and do not contribute to the understanding of the various embodiments of the invention are omitted from the drawings to enhance clarity. In addition, it will be appreciated that the characterizations of various components and orientations described herein as being "vertical" or "horizontal", "right" or "left", "side", "top" or "bottom", or the like are relative characterizations only and are based upon the particular position or orientation of a given component for a particular application.

FIG. 1 is a sectional view of an embodiment of a comminution apparatus 100 supported on a table 52 of a milling machine 50, components of which are shown in dotted lines. The milling machine 50 may be, for example, a 15 HP Keamey & Trecker Horizontal Milling Machine. However, the milling machine may be of any suitable design. Also, although the comminution apparatus 100 is shown in conjunction with milling machine 50, it will be understood that any suitable arrangement for powering the comminution apparatus 100 may be used, including, for example, a dedicated electrical motor.

The comminution apparatus 100 may include a cutting chamber 102 supported on a frame, and a cutter 106 that is supported on an arbor 108. The arbor 108 is located outside the cutting chamber 102 and may be powered by the milling machine 50. The cutter 106 may include a plurality of blades 110, each having multiple teeth 114. Spacers 112, which may be of relatively large diameter, may be included on the arbor 108 to separate and thereby improve rigidity of the blades 110.

In the embodiment shown in FIG. 1, the cutting chamber 102 includes an interior volume having a generally V-shaped cross-section when sectioned transverse to the axis of arbor 108. The V-shaped profile allows the feed material to drop down by gravity from an infeed chute 118 and accumulate within a relatively small region at the bottom portion 116 of the cutting chamber 102. This design enhances the efficiency of the cutting. A first baffle 120 may be used to direct feed material toward the bottom portion 116 of the cutting chamber 102. The internal angle a defined by the V-shaped cross-section of the V of the cutting chamber 102 preferably is an acute angle.

Figure 6:
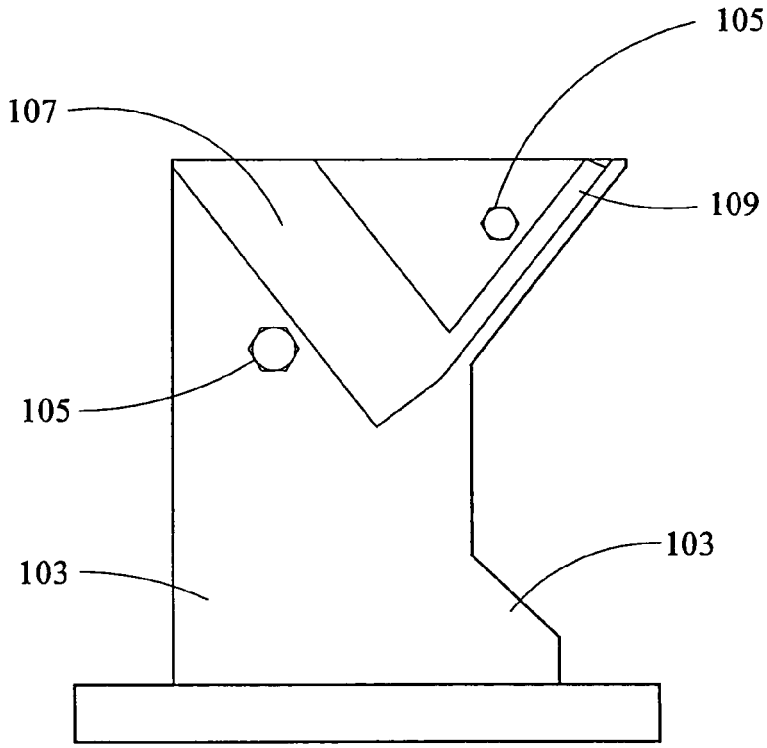
FIG. 6 is a side elevational view of an embodiment of an end support of a cutting chamber according to the present invention.
Figure 7:
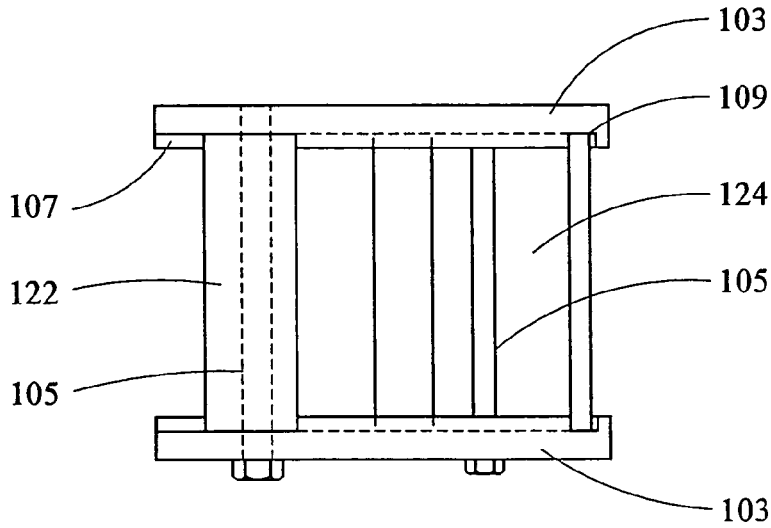
FIG. 7 is a top view of an embodiment of a cutting chamber according to the present invention.

The comminution apparatus 100 may include two generally plate-shaped wall members in the forms of an anvil 122 and a feed plate 124. At least the surfaces of the anvil 122 and feed plate 124 forming interior surfaces of the cutting chamber 102 may be generally smooth. The anvil 122 and a feed plate 124 are supported on the frame 104 by any suitable known means, such as, for example, retainers and flanges and/or bolts attached to the frame 104. In one embodiment, and as shown in FIGS. 6 and 7, the frame 104 may comprises two end supports 103 held in place at a distance from one another by fasteners 105. One side of each end support 103 may include channels providing an inclined anvil recess 107 and an inclined feed plate recess 109 for receiving an end of the anvil 122 and an end of the feed plate 124, respectively. After opposed ends of the anvil 122 and the feed plate 124 have been positioned in their respective recesses 107, 109 in each end support 103, the fasteners 105 are tightened, and the anvil 122 and the feed plate 124 thereby form the sides of the "V" of the cutting chamber 102, with the internal angle $\alpha$ therebetween.

Figure 3:
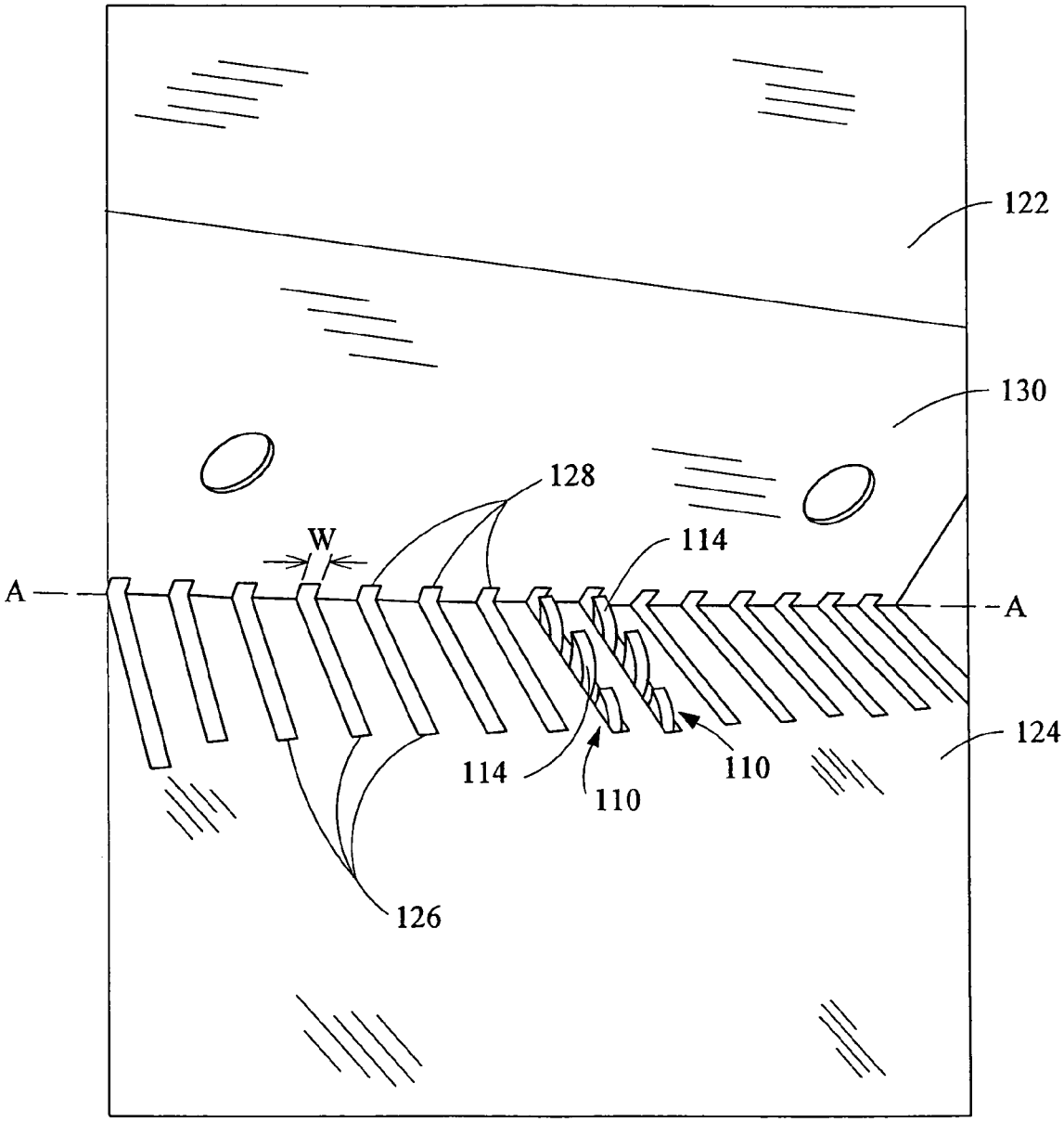
FIG. 3 is a top perspective view of a cutting region of an embodiment of a cutting chamber according to the present invention.

The feed plate 124 may include a plurality of slots 126 (referred to herein as "feed slots") through which a portion of each of the blades 110 of the cutter 106 enter the bottom portion 116 of the cutting chamber 102. The anvil 122 may also include a plurality of slots 128 (referred to herein as "anvil slots") through which the blades 110 exit the cutting chamber 102. As seen in FIG. 3, for example, the direction of rotation of blades 110 is toward the anvil 122. The feed material at the bottom of the cutting chamber 102 is trapped between the anvil 122 and the cutting surfaces of the rotating blades 110 and is sheared to smaller particles. Some comminution of the feed material also may occur through crushing and impact action in the cutting chamber 102. The processed feed material may exit the cutting chamber 102 after it has been reduced to a size that can pass through the width "w" of the anvil slots 128.

The anvil 122 may be of one-piece construction or it may include, for example, an insert 130 permanently or removably attached to a bottom portion of the anvil 122 that is composed of a material different from the remainder of the anvil 122. The insert 130 may have mechanical properties particularly suited to the stresses to which it is subjected through the cutting action of the blades 110. When the insert 130 is used, the anvil slots 128 may be formed directly on the insert 130 through action of the teeth 114. The anvil slots 128 and the feed slots 126 may be made by cutting them in place using the same number of blades 110, such as, for example, the sixteen blades 110 shown in the embodiment of FIG. 2. To cut the anvil slots 128 and the feed slots 126, the frame 104 may be positioned progressively closer to the blades 110 such that the blades 110 incrementally cut through the feed plate 124 and through the anvil 122 until they extend through the opposite side of the feed plate 124 and anvil 122 to a desired distance. The desired distance, which may be, for example, 0.05 inches, is greater than an operational distance, which is the distance to which the blades 110 extend into the cutting chamber 102 during operation of the comminution apparatus 100. The operational distance may be 0.025 inches, for example. After the anvil slots 128 and the feed slots 126 have been cut in this manner, the insert 130 may be removed and hardened using conventional metallurgical techniques before being re-installed to complete one region of the cutting chamber 102.

Figure 8:
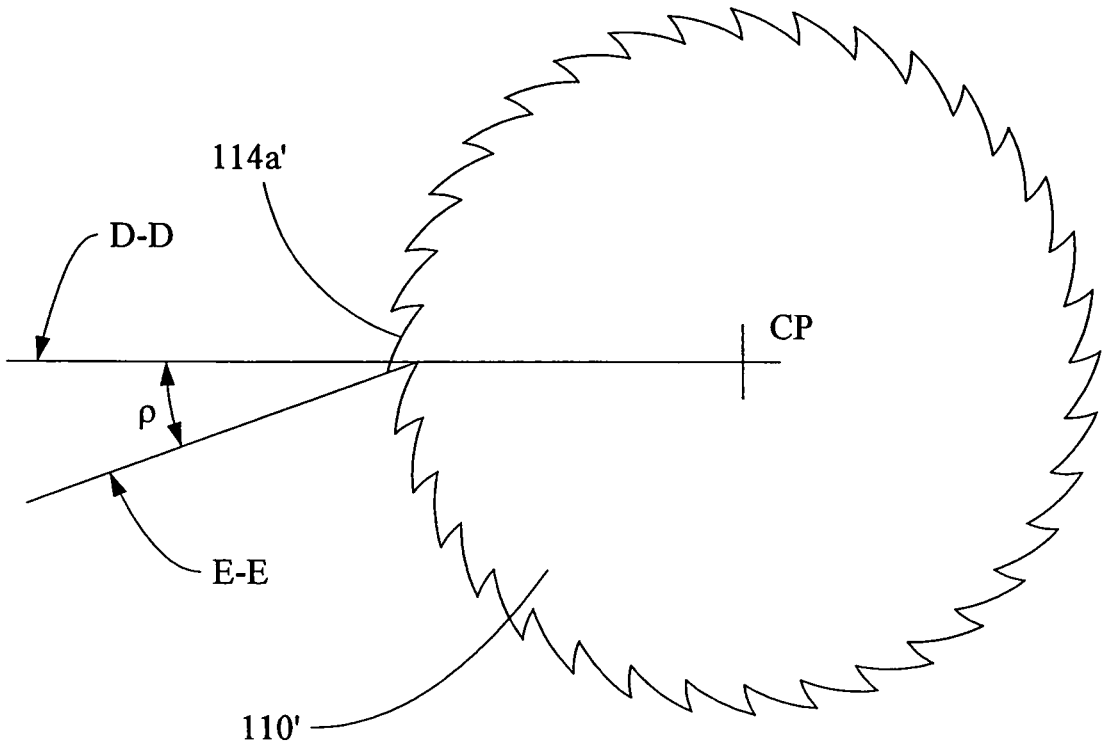
FIG. 8 is a schematic diagram illustrating blade teeth having positive rake.

The teeth 114 of the blades 110 preferably have about 3–5° positive angle or "rake". The preferred 3–5° positive rake of the teeth 114 is illustrated in FIG. 8, wherein the centerline D—D drawn from the center point CP of blade 110' to a base of tooth 114*a*' forms the 3–5° angle $\rho$ with a line E—E tangent to the cutting face of the tooth 114'. It is believed that incorporating teeth having a positive rake aids in cleanly shearing particles from the feed material, with less likelihood that feed material will stick or smear on the blade teeth.

Figure 2:
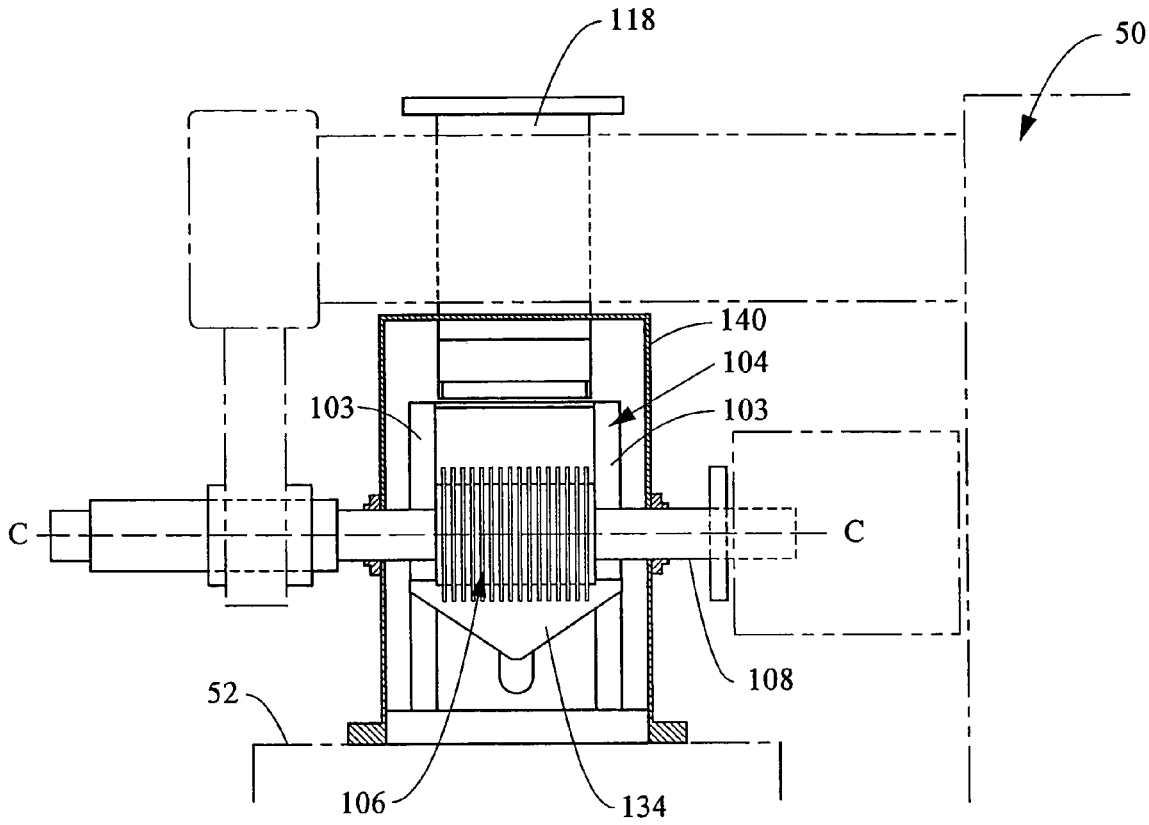
FIG. 2 is a longitudinal elevational sectional view of an embodiment of a cutting chamber according to the present invention of the embodiment of FIG. 1.
Figure 4:
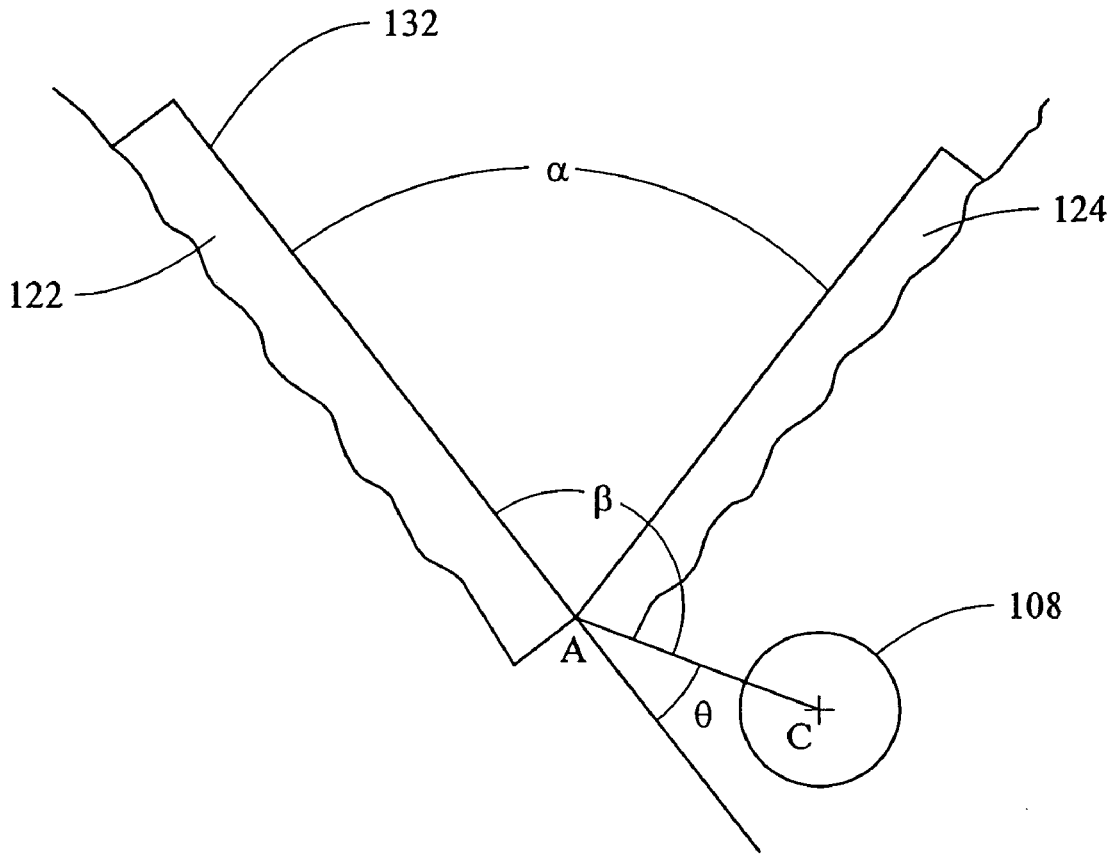
FIG. 4 is a diagrammatic view showing relative positions of elements of an embodiment of a comminution apparatus according to the present invention.

To further enhance shearing of the feed material, the effective positive rake of the blade teeth may be increased by suitably positioning the anvil 122 relative to the arbor 108. The arbor 108 is located outside the cutting chamber 102 such that the teeth 114 of the blades 110 protrude into the bottom portion 116 of the cutting chamber 102. As shown in FIGS. 2 through 4, the angle $\beta$ defined between the inner surface 132 of the anvil 122 and the plane passing through the center axis C—C of the arbor 108 (identified in FIG. 2) and the bottom edge A—A of anvil 122 (identified in FIG. 3) may be selected so as to increase the effective positive rake of the teeth 114. In the embodiment of FIG. 4, for example, the angle $\beta$ may be 155°, such that the angle $\theta$ is 25° (180°−155°=25°). If blades included in the embodiment of FIG. 4 have teeth with 3–5° positive rake, for example, the teeth will benefit from an additional 25° of effective positive rake, making the total effective positive rake of the teeth about 28–30°. This further improves the ability of the teeth to cleanly shear the feed material and avoid particle smearing and sticking.

Again referring to FIG. 4, the distance AC between the edge A—A and the axis C—C also may be selected to provide an optimum depth of the teeth 114 into the cutting chamber 102 so as to optimally comminute feed material. In one embodiment, the distance AC may be, for example, 2 inches for blades having a 4-inch diameter. In addition, angles $\alpha$ and $\beta$ may be selected so that the teeth 114 rotating through the feed chamber 102 pass through positions above the slots 128 in the insert 130 before passing through the slots 128. In the embodiment of FIG. 4, for example, which includes an angle $\beta$ of 155°, angle $\alpha$ may be 75°. This enhances agitation of the feed material and exposes new surfaces for cutting.

The location of a portion of the teeth 114 at the bottom portion 116 of the cutting chamber 102 and the constant rotation of the blades 110 cause the particles of feed material in the cutting chamber 102 to be continuously agitated, such that they fall repeatedly at new angles in the path of the teeth 114 and are cut repeatedly. This occurs until the particles of the feed material are reduced to a desired size and fall from the cutting chamber 102 through the anvil slots 128 into a collection hopper 134. See FIGS. 1 and 2. A second baffle 136 may positioned to direct the processed feed material from the cutting chamber 102 to the collection hopper 134.

Moreover, since oversize particles cannot fall through the anvil slots 128 or the feed slots 126, the resulting product has a narrow size distribution.

Figure 5:
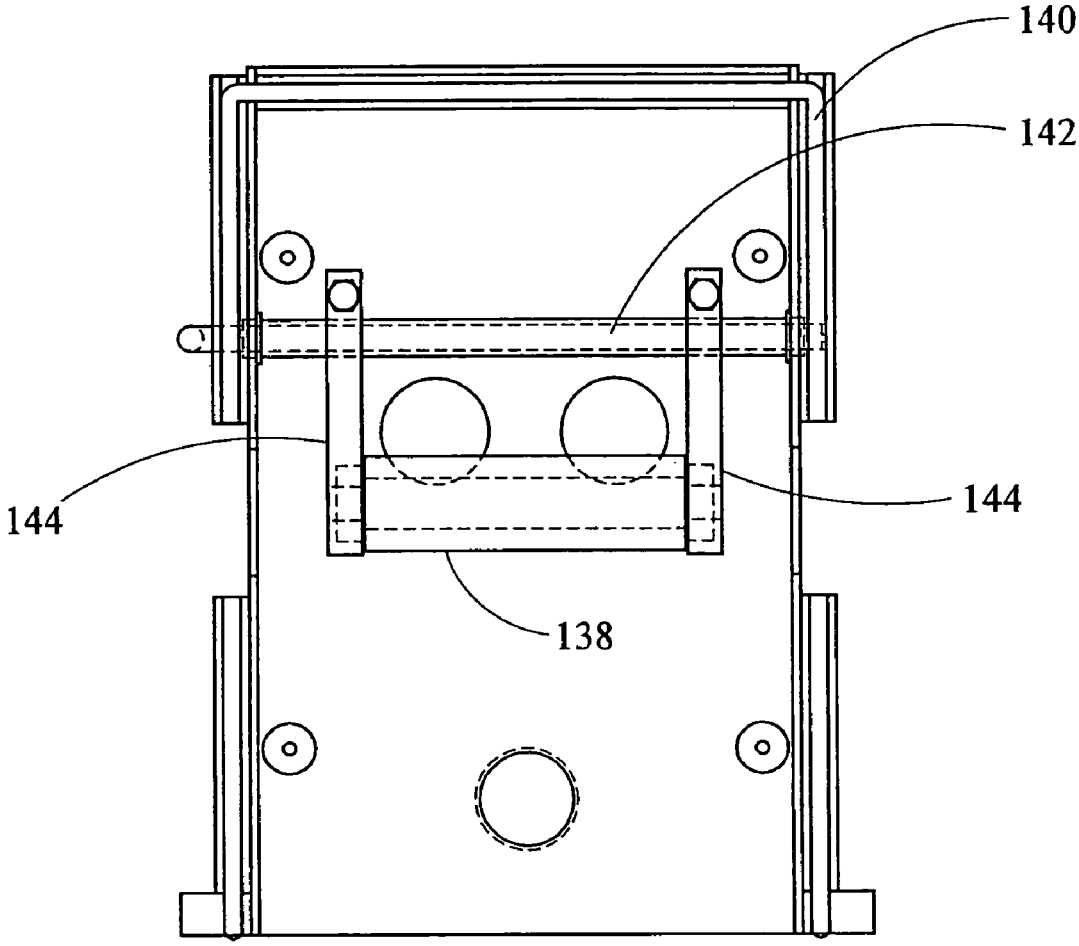
FIG. 5 is a side view of the embodiment of FIG. 1 wherein certain elements have been excluded and showing a position of a cleaning roller of the embodiment.

In one embodiment, as shown in FIGS. 3 and 5, the teeth 114 of the blades 110 may be cleaned continuously during operation by a cleaning roller 138. The cleaning roller 138 may have an outer surface of rubber or a flexible rubber-like material, such as, for example, polyurethane. The cleaning roller 138 may be supported on a housing 140 enclosing the comminution apparatus 100 or on another supporting structure inside the comminution apparatus 100, such that the cleaning roller 138 rotates freely against the teeth 114 of the several blades 110. As will be understood from FIG. 1, the direction of rotation of the cleaning roller 138 is opposite from the direction of rotation of the blades 110. The cleaning roller 138 may remove any material that accumulates within gullets of the teeth 114. The roller 138 may be supported on shaft 142 by two arms 144, such that the cleaning roller may freely swing from the shaft 142 against the teeth 114 of the blades 110 by the action of gravity and/or by an applied biasing force as the blades 110 rotate.

In one embodiment, excess heat that is generated during reduction may be removed by providing a water line or other coolant line 146 to cool the anvil 122 by passage of the coolant through suitable coolant channels (not shown) in the anvil 122. When reducing feed materials that may be susceptible to fire during reduction, such as, for example, titanium and zirconium, argon or another inert atmosphere may be provided in the housing 140 through an inlet 148. The processed feed material may be removed from the collection hopper 134 through an exit tube 150 connected to a standard vibrator 152 such as, for example, a Syntron 159146-D vibrator, and into a storage container 154 filled with argon or another inert gas or inert gas mixture.

The comminution apparatus 100 was successfully tested with feed materials including zirconium particles, titanium particles, zirconium machine turnings and titanium machine turnings. These are non-brittle materials that typically tend to gall and smear during reduction to particles. Because of this tendency, these materials are hard or impossible to reduce to small size with a conventional rock crusher.

In one test, 40 lbs. of zirconium particles smaller than ¼ inch in size but too large to pass through a 10 mesh screen (about 0.079 inch) were reduced to a size passing through a 10 mesh screen in 22 minutes using the comminution apparatus 100 without the occurrence of any significant smearing. In the test, 16 blades having an The tests confirmed that both zirconium and titanium, materials that are particularly difficult to reduce to particles, can be reduced to a desired particle size by the comminution apparatus of the present invention. The comminution apparatus may be used to cut other materials that are hard to reduce to small size. Without intending to limit the invention in any way, such materials include, for example, magnesium, niobium, calcium, copper, potassium, hafnium and aluminum. Additional metals, alloys and non-metals also may be cut to very small particle size using the present invention.

Whereas particular embodiments of the invention have been described herein for the purpose of illustrating the invention and not for the purpose of limiting the same, it will be appreciated by those of ordinary skill in the art that numerous variations of the details, materials and arrangement of parts may be made within the principle and scope of the invention without departing from the spirit of the invention. The preceding description, therefore, is not meant to limit the scope of the invention. Rather the scope of the invention is to be determined only by the appended claims and their equivalents. inner diameter of one inch, an outer diameter of four inches and a width of 3/32 inch were installed on a one-inch diameter arbor and run at a speed of 61 rpm. A spacer separated each of the blades on the arbor. Each spacer had an inner diameter of one inch, an outer diameter of three inches and a width of 3/16 inch.

In a second test, titanium sponge feed material was processed at a rate of 21 lbs. per hour using the comminution apparatus 100. During the second test, the blades extended into the cutting chamber to a depth of about 0.047 inch, and the arbor was run at a speed of 61 rpm. The titanium sponge feed material was analyzed to determine its mesh size distribution, and a similar analysis was performed on the material after processing in the comminution apparatus (the "final material"). The following table provides the results of the analyses.

| Mesh Size | Feed Material (wt. %) | Final Material (wt. %) |
|---|---|---|
| +8 | 84% | 14% |
| −8 to +10 | 13% | 34% |
| −10 to +20 | 3% | 37% |
| −20 to +32 | — | 9% |
| −32 to +80 | — | 5% |
| −80 to +pan | — | 1% |

What is claimed is:

1. A method for reducing a particle size of a metallic feed material, the method comprising:

providing a comminution apparatus comprising:

a cutting chamber comprising a first member and a second member forming an angle therebetween such that the cutting chamber has a V-shaped cross section, wherein each of the first member and the second member includes a plurality of slots therethrough providing access into the cutting chamber; and a rotatable arbor disposed outside of the cutting chamber and supporting a plurality of toothed blades thereon such that during rotation of the arbor a tooth of each of the blades enters the cutting chamber through the slots in the first member and exits the cutting chamber through the slots in the second member;

introducing the metallic feed material into the cutting chamber, wherein the metallic feed material is a metal selected from the group consisting of zirconium, titanium, magnesium, niobium, calcium, copper, potassium, hafnium and aluminum, or an alloy thereof; and rotating the arbor to thereby rotate the plurality of blades and agitate and comminute the metallic feed material within the cutting chamber.

2. The method of claim 1, wherein rotating the plurality of blades reduces a particle size of the metallic feed material to no greater than mesh size 10.

3. The method of claim 1, wherein a plurality of teeth of the toothed blades have a positive rake.

4. The method of claim 1, wherein the cutting chamber includes two end supports, each end support having a first recess and a second recess for receiving an end of the first member and an end of the second member, respectively.

5. The method of claim 1, wherein the first member includes an insert through which are formed the plurality of slots in the first member.

6. The method of claim 1, wherein the comminution apparatus further comprises a housing enclosing the cutting chamber and the arbor.

7. The method of claim 6, wherein the housing is adapted to be supported on a table of a milling machine, and wherein the milling machine rotates the arbor.

8. The method of claim 7, wherein the comminution apparatus further comprises a cleaning roller rotatably supported on the housing and contacting the blades during rotation.

9. The method of claim 8, wherein the first member includes at least one coolant channel therein.

10. The method of claim 6, wherein the housing includes an inlet for introduction of an inert gas into the housing.

11. The method of claim 1, wherein the blades are separated on the arbor by spacers disposed intermediate adjacent blades.

12. The method of claim 1, wherein the comminution apparatus further comprises a collection hopper communicating with and receiving processed material from the cutting chamber.

13. The method of claim 1, wherein the plurality of slots in the first member and the plurality of slots in the second member provide access to a bottom portion of the cutting chamber.

* * * * *